US008915209B2

(12) United States Patent
Wang

(10) Patent No.: US 8,915,209 B2
(45) Date of Patent: Dec. 23, 2014

(54) PAINT ROLLER WITH AN END-SURFACE BLOCKING STRUCTURE

(71) Applicant: Kai Wang, Taichung (TW)

(72) Inventor: Kai Wang, Taichung (TW)

( * ) Notice: Subject to any disclaimer, the term of this patent is extended or adjusted under 35 U.S.C. 154(b) by 57 days.

(21) Appl. No.: 13/874,756

(22) Filed: May 1, 2013

(65) Prior Publication Data

US 2013/0239351 A1 Sep. 19, 2013

Related U.S. Application Data

(63) Continuation-in-part of application No. 13/196,236, filed on Aug. 2, 2011, now Pat. No. 8,719,992.

(51) Int. Cl.
*B05C 17/02* (2006.01)

(52) U.S. Cl.
CPC ..... *B05C 17/0222* (2013.01); *B05C 17/0225* (2013.01)
USPC ..... 118/264; 118/504; 118/505; 15/230.11; 15/248.2

(58) Field of Classification Search
CPC ..... B05C 17/0222; B05C 17/0225
USPC ..... 118/264, 504, 505; 15/230.11, 248.2; 401/208, 218, 219; 492/13
See application file for complete search history.

(56) References Cited

U.S. PATENT DOCUMENTS

| | | | | |
|---|---|---|---|---|
| 5,623,740 | A * | 4/1997 | Burns et al. | 15/230.11 |
| 6,925,674 | B2 * | 8/2005 | Prince et al. | 15/230.11 |
| 7,281,292 | B1 * | 10/2007 | Felix | 15/230.11 |
| 7,340,796 | B2 * | 3/2008 | Pyles | 15/114 |
| 2002/0194691 | A1 * | 12/2002 | Meyer | 15/230.11 |

* cited by examiner

*Primary Examiner* — Laura Edwards

(57) ABSTRACT

A paint roller with an end-surface blocking structure is provided with a mounting stem coupled to a handle, a roller sleeved on the mounting stem, a connecting sleeve sleeved on the mounting stem, and an end-surface blocking piece pivoted to the connecting sleeve. The pivot connection of the connecting sleeve with the second pivot allows the connecting sleeve to pivot around the first direction and allows the end-surface blocking piece which is pivoted to the connecting sleeve to pivot around the second direction, so that the end-surface blocking piece is capable of rotating in two different directions, which improves flexibility when operating the paint roller.

3 Claims, 8 Drawing Sheets

PAINT ROLLER WITH AN END-SURFACE BLOCKING STRUCTURE

This application is a continuation in part of U.S. patent application Ser. No. 13/196,236, which claims the benefit of the earlier filing date of Aug. 2, 2011, now U.S. Pat. No. 8,719,992.

BACKGROUND OF THE INVENTION

1. Field of the Invention

The present invention relates to a paint roller, and more particularly to a paint roller with an end-surface blocking piece to prevent paint from overflowing to the surface of a wall that doesn't need to be painted.

2. Description of the Prior Art

Referring to FIGS. 1-2, a conventional paint roller 10 comprises a handle 11 and a roller 12 moveably mounted on the handle 11. When the paint roller 10 is used to paint a wall X with a right angle, the end surface and the peripheral surface of the roller 12 will be in contact with the two surfaces that define the right angle of the wall. Therefore, an end-surface blocking assembly 13 is pivoted to a side handle 14 to prevent the end surface of the roller 12 from contacting the wall X.

The end-surface blocking assembly 13 comprises a first and second pieces 131, 132 which are connected and pivoted to the side handle 14 by a pivot 133. One side of the end-surface blocking assembly 13 is a flat and straight abutting surface 134 which is pressed against the wall X to prevent the paint from the end surface of the paint roller 10 from painting on the wall X. Another side of the end-surface blocking assembly 13 is provided with an elastic pressing member 135 which is pressed to bring the roller 12 into closer contact with the wall X. However; to change the blocking direction of the end-surface blocking assembly 13 with respect to the wall X, it has to turn the direction of the roller, and then it has to turn the end-surface blocking assembly 13, as shown in FIG. 2, to make the abutting surface 134 of the end-surface blocking assembly 13 press against the wall X. Therefore, this type of paint roller 10 is inconvenient to use. Furthermore, the end-surface blocking assembly 13 has too many components and is difficult to assemble, which increases the production cost.

FIG. 3 shows another conventional paint roller 20 which comprises a rotary roller 21, an elastic piece 22 connected to a side piece 23, and an end surface blocking piece 24 pivoted to the side piece 23, so that the end surface blocking piece 24 is pivotable with respect to the end surface of the rotary roller 21. When the paint roller 20 is used to paint a corner, the end surface blocking piece 24 can prevent the paint from the end surface of the rotary roller 21 from painting on the undesired wall X. The elastic piece 22 will deform when the end surface blocking piece 24 is pressed against the wall X to change the distance between the side piece 23 and the end surface blocking piece 24, allowing the rotary roller 21 to flatly abut against the wall X.

However, the distance between the side piece 23 and the end surface blocking piece 24 changes with the deformation of the elastic piece 22, and the deformation amount and direction of the elastic piece 22 is determined by the direction of force applied by the user, namely, the deformation amount of the elastic piece 22 is not fixed and unpredictable, so that the distance between the side piece 23 and the end surface blocking piece 24 is also unpredictable, which makes it difficult to control the painting operation.

The present invention has arisen to mitigate and/or obviate the afore-described disadvantages.

SUMMARY OF THE INVENTION

The primary objective of the present invention is to provide a paint roller with an end-surface blocking structure capable of overcoming the disadvantages of the conventional pain roller.

To achieve the above objective, a paint roller with an end-surface blocking structure in accordance with the present invention comprises: a handle, a mounting stem, a roller, a connecting sleeve and an end-surface blocking piece. The mounting stem is coupled to the handle and includes an extension portion on which being formed a first pivot and a second pivot which extend along a first direction, and a direction perpendicular to the first direction is defined as a second direction. The first and second pivots are cylindrical structures, on an outer surface of the second pivot is formed a restricting protrusion which includes a first abutting surface and a second abutting surface, and the first and second abutting surfaces define a restricting-protrusion angle with respect to an axis of the second pivot.

The roller is rotatably sleeved on the first pivot of the mounting stem.

The connecting sleeve includes an inserting hole and a restricting cavity in communication with the inserting hole, the restricting cavity includes a first inner surface and an opposite second inner surface which define a restricting-cavity angle with respect to an axis of the inserting hole, and the restricting-cavity angle is larger than the restricting-protrusion angle. The connecting sleeve is further provided with two ears, the connecting sleeve is rotatably mounted on the mounting stem in such a manner that the second pivot is inserted in the inserting hole, and the restricting protrusion is received in the restricting cavity to allow the connecting sleeve to pivot around the second pivot and the first direction within a limited angle.

The end-surface blocking piece includes a blocking portion, an arm portion and a pivoting portion sequentially connected one another. The blocking portion is a round sheet structure with an inner surface and an outer surface, and the pivoting portion of the end-surface blocking piece is pivoted between the two ears of the connecting sleeve in such a manner that the inner surface of the blocking portion of the end-surface blocking piece is located toward an end surface of the roller, and the end-surface blocking piece is able to pivot around the second direction to pivot toward or away from the roller.

The pivot connection of the connecting sleeve with the second pivot allows the connecting sleeve to pivot around the first direction and allows the end-surface blocking piece which is pivoted to the connecting sleeve to pivot around the second direction, so that the end-surface blocking piece is capable of rotating in two different directions, which improves flexibility when operating the paint roller of the present invention.

DETAILED DESCRIPTION OF THE PREFERRED EMBODIMENTS

Figure 1:
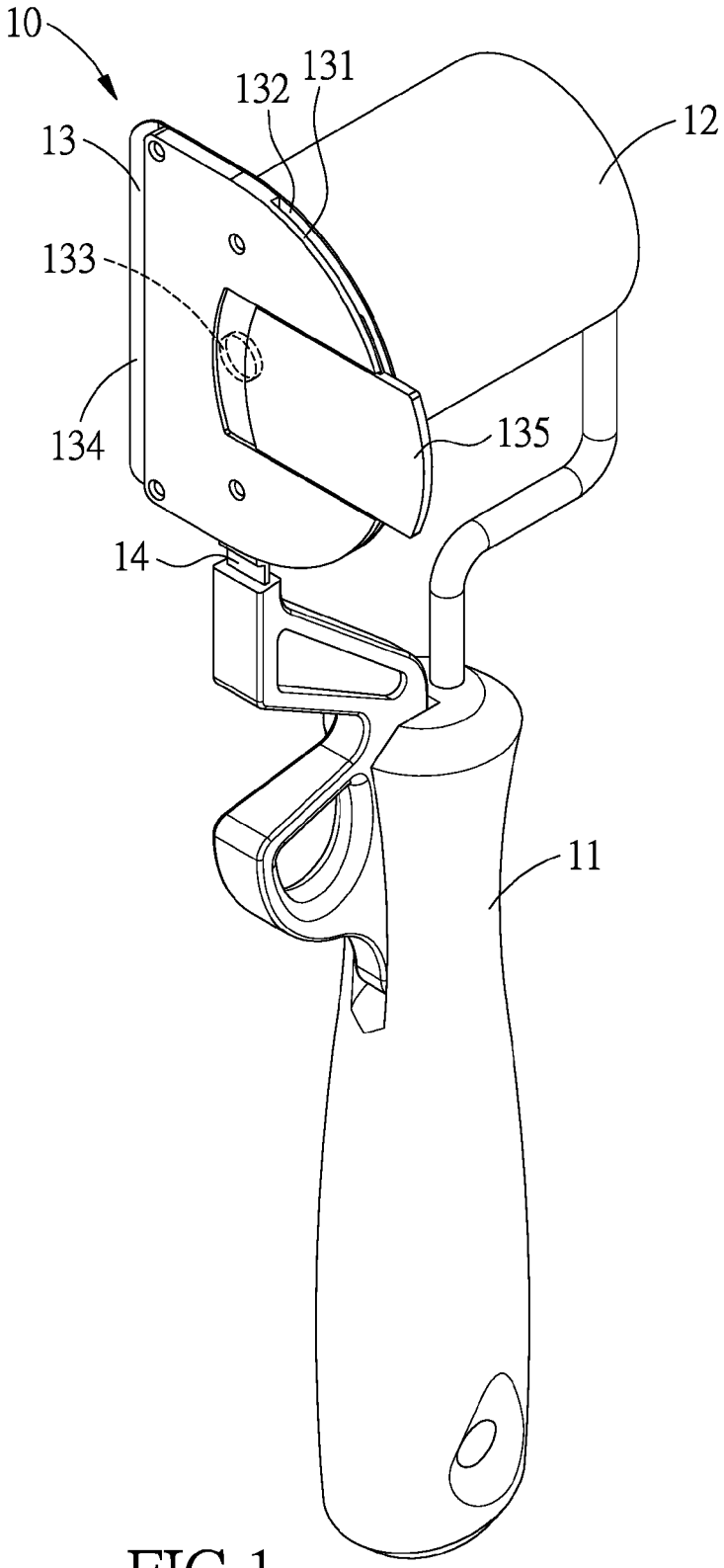
FIG.1 PRIOR ART
FIG. 1 is a perspective view of a conventional paint roller.
Figure 2:
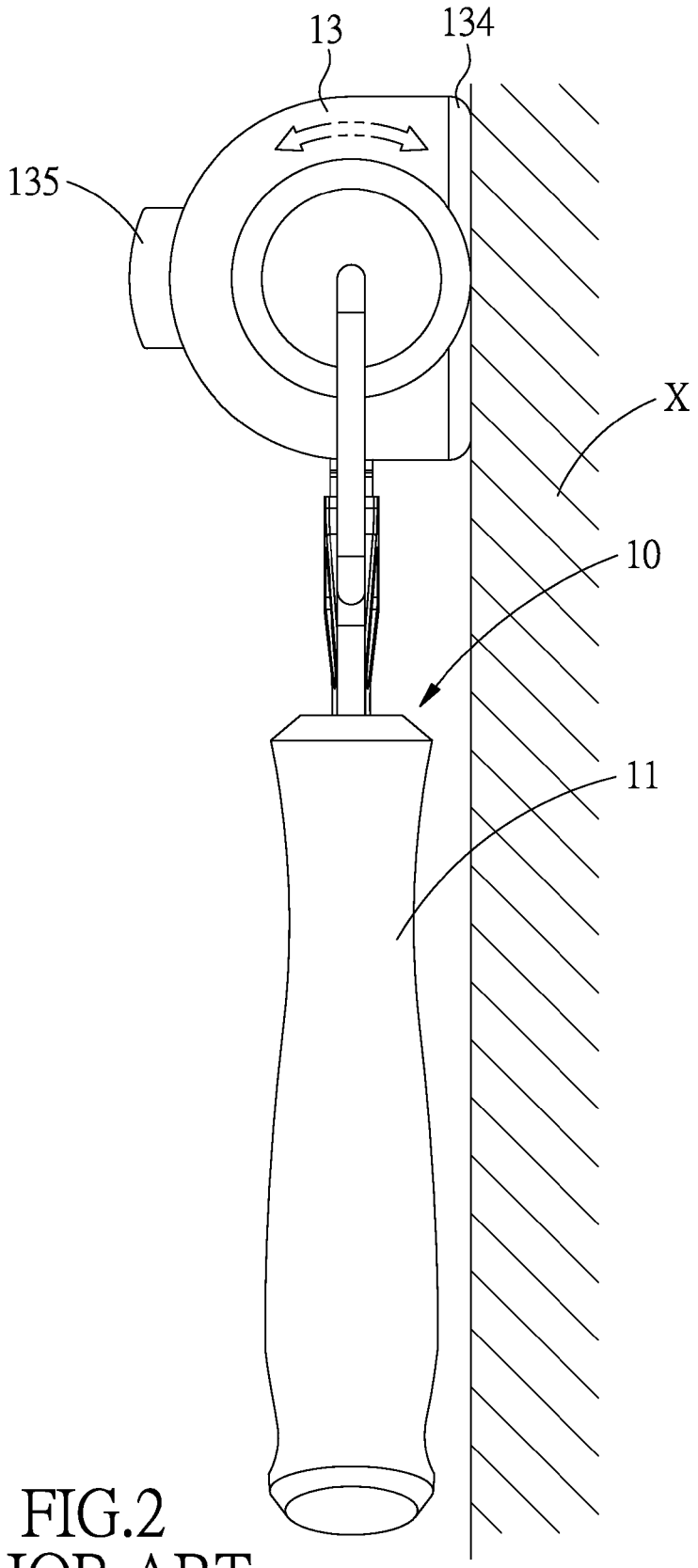
FIG.2 PRIOR ART
FIG. 2 is an operational view of the conventional paint roller.
Figure 3:
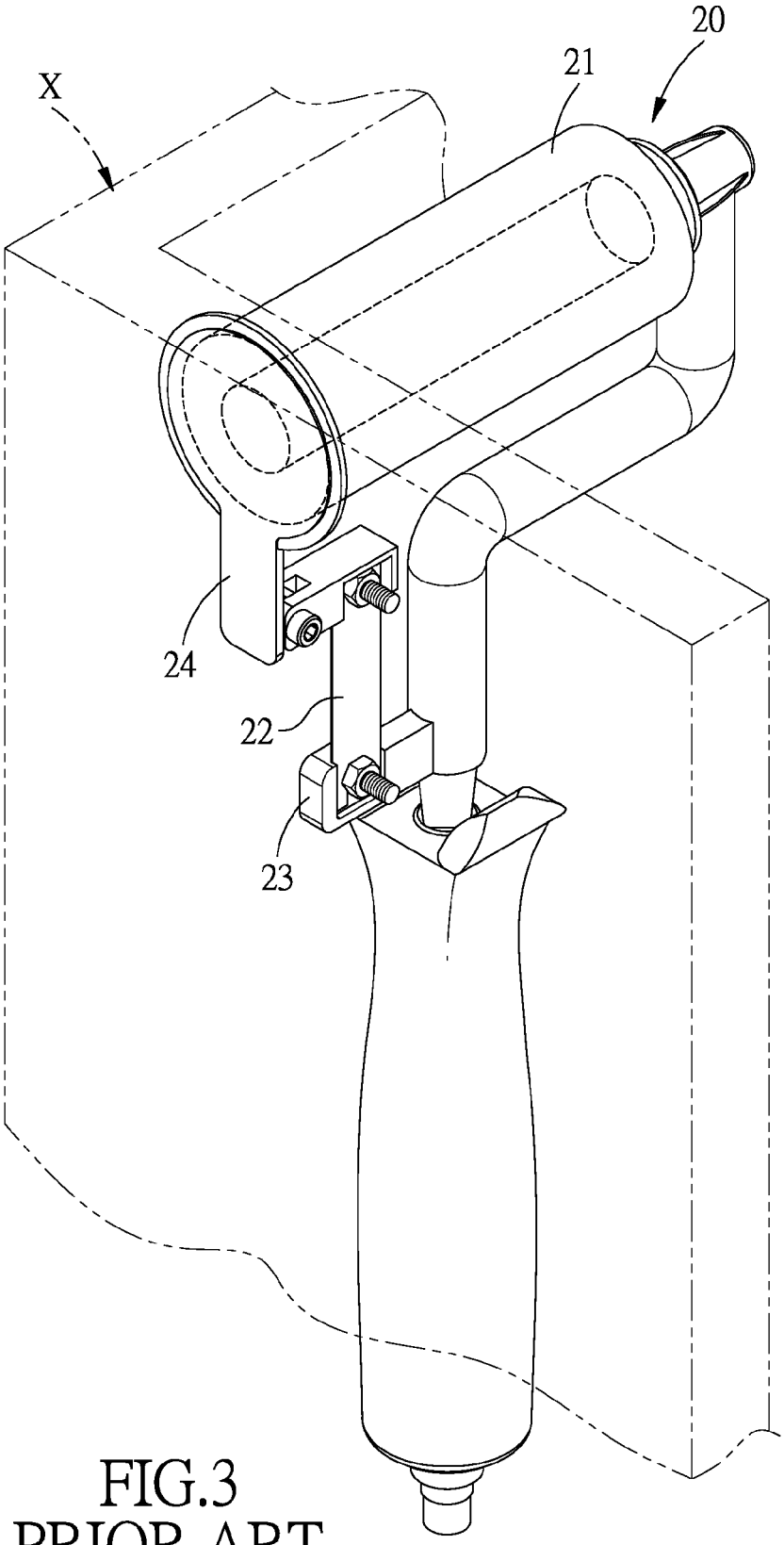
FIG.3 PRIOR ART
FIG. 3 is another operational view of the conventional paint roller.
Figure 4:
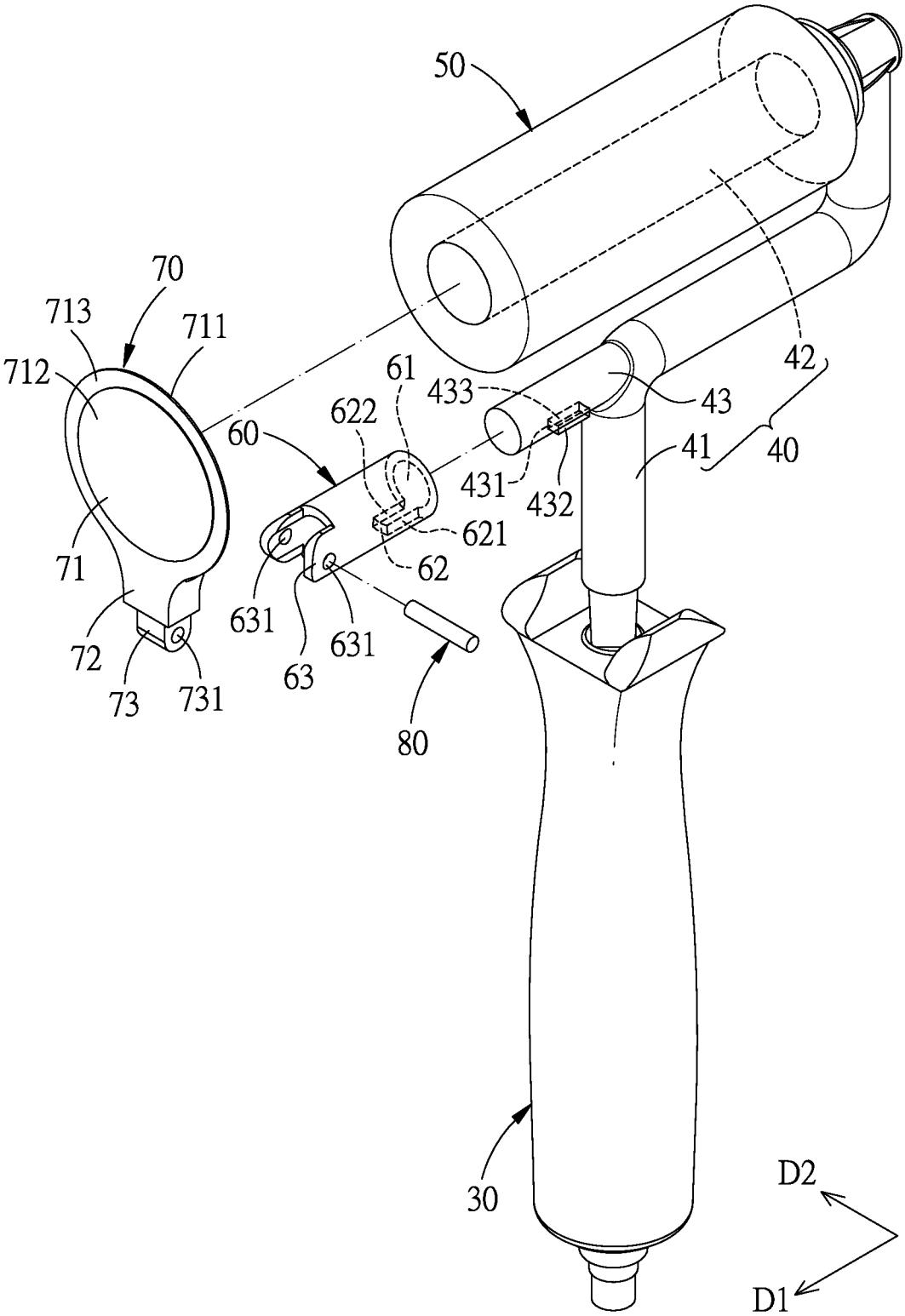
FIG. 4 is an exploded view of a painter roller with an end-surface blocking structure in accordance with the present invention.

The present invention will be clearer from the following description when viewed together with the accompanying drawings, which show, for purpose of illustrations only, the preferred embodiment in accordance with the present invention.

Referring to FIGS. 4-8, a paint roller with an end-surface blocking piece in accordance with the present invention comprises: a handle 30, a mounting stem 40, a roller 50, a connecting sleeve 60 and an end-surface blocking piece 70.

The mounting stem 40 is disposed at one end of the handle 30 and includes an extension portion 41 on which being formed a first pivot 42 and a second pivot 43 which extend along a first direction D1, and a direction perpendicular to the first direction D1 is defined as a second direction D2. The first and second pivots 42, 43 are cylindrical structures. On the outer surface of the second pivot 43 is formed a restricting protrusion 431 which includes a first abutting surface 432 and a second abutting surface 433, and the first and second abutting surfaces 432, 433 define a restricting-protrusion angle θ1 with respect to the axis of the second pivot 43. The extension portion 41 has one end coupled to the handle 30.

The roller 50 is rotatably sleeved on the first pivot 42 of the mounting stem 40.

Figure 6:
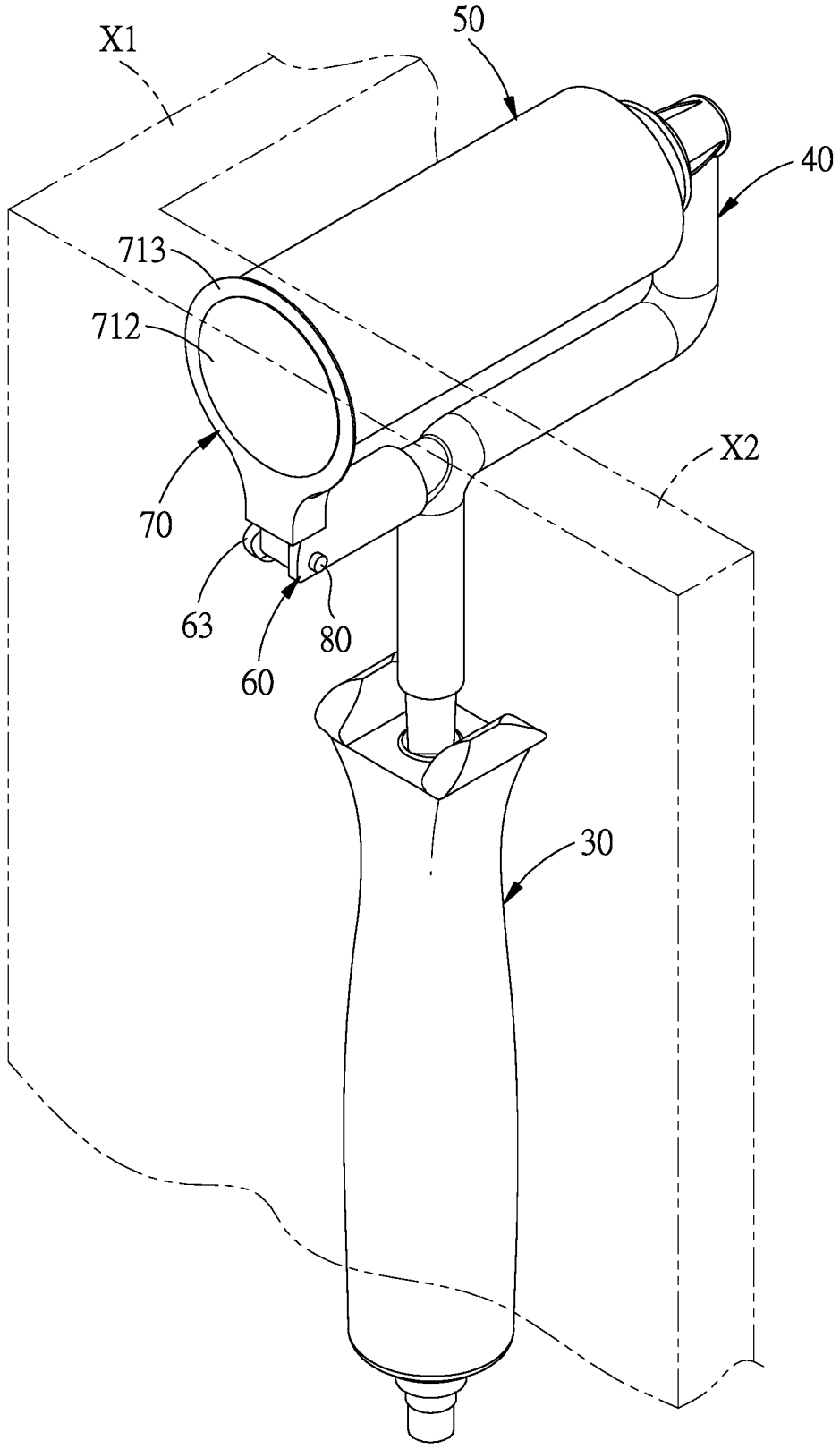
FIG. 6 that the painter roller with an end-surface blocking structure in accordance with the present invention is used to paint a right-angle corner of a wall.
Figure 7:
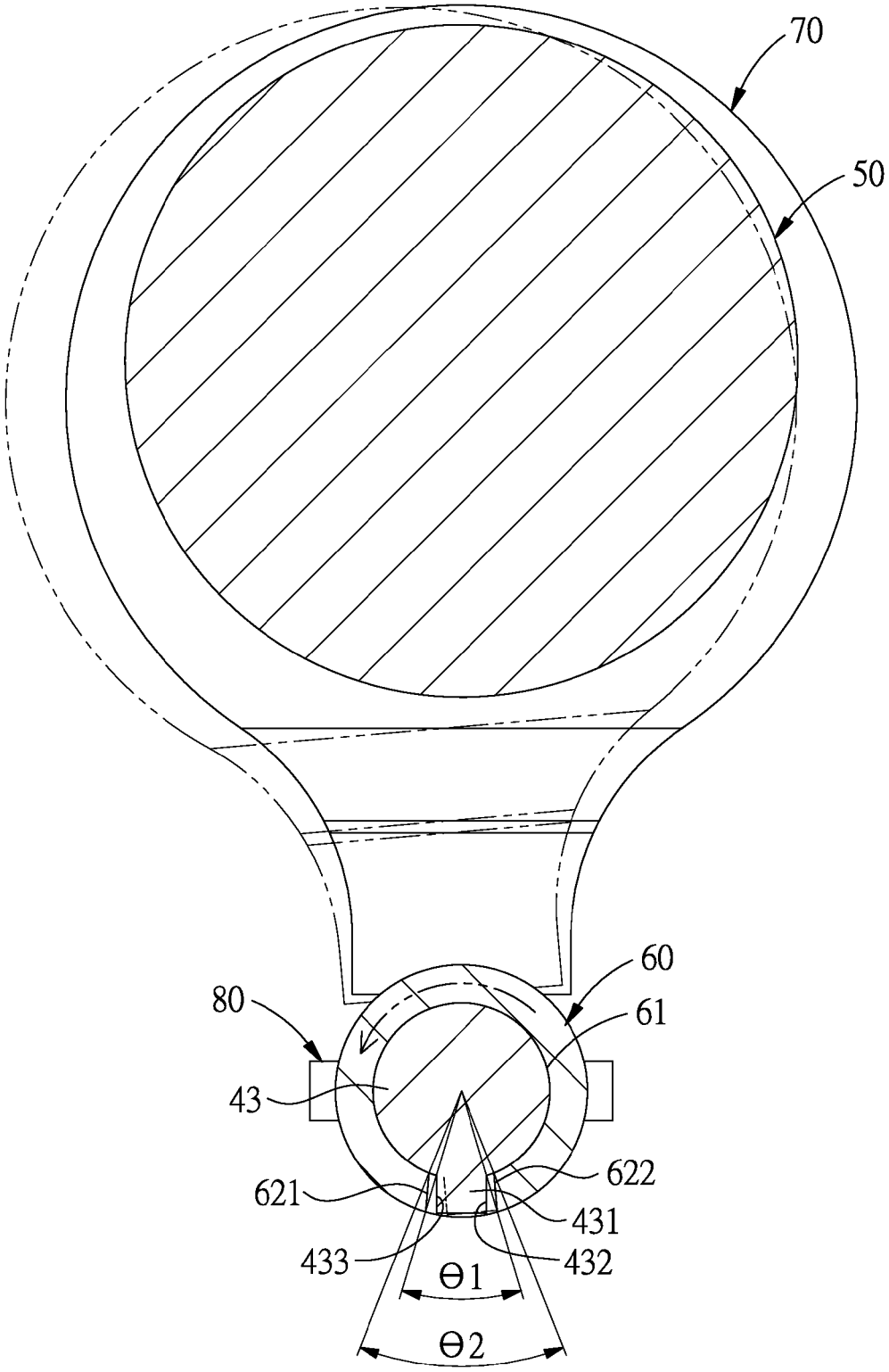
FIG. 7 illustrates the limited rotation of the connecting sleeve with respect to the roller of the present invention.
Figure 8:
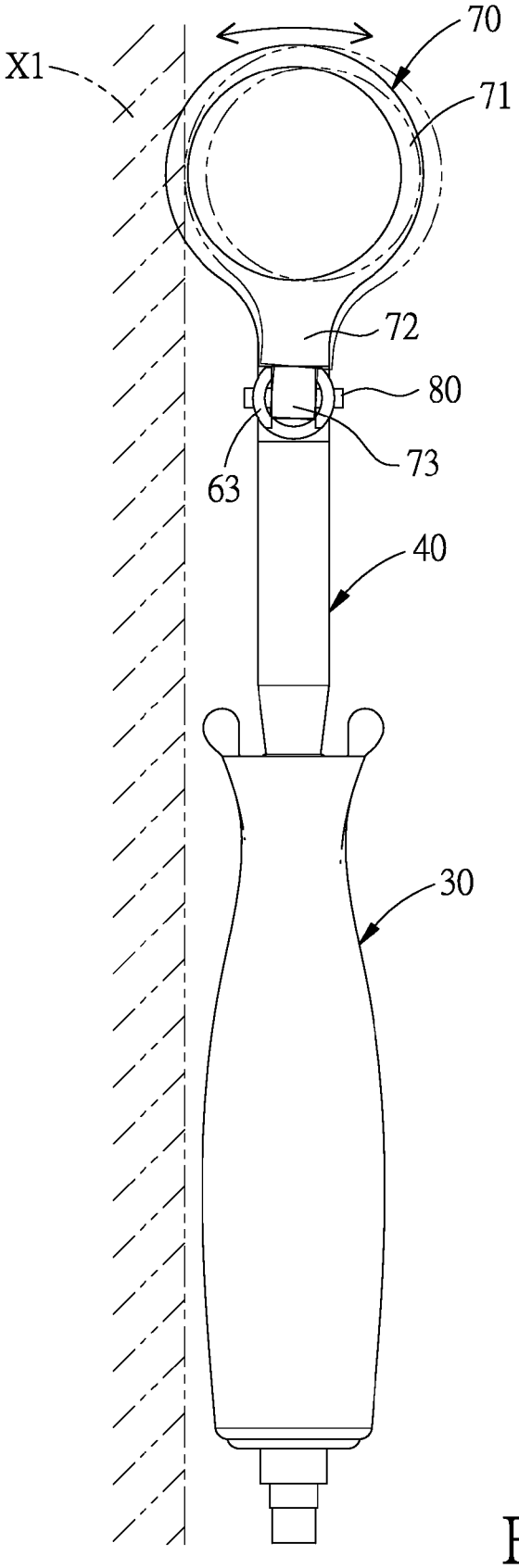
FIG. 8 is another operational view of the painter roller with an end-surface blocking structure in accordance with the present invention.

The connecting sleeve 60 includes an inserting hole 61 and a restricting cavity 62 in communication with the inserting hole 61. The restricting cavity 62 includes a first inner surface 621 and an opposite second inner surface 622 which define a restricting-cavity angle θ2 with respect to the axis of the inserting hole 61, and the restricting-cavity angle θ2 is larger than the restricting-protrusion angle θ1. The connecting sleeve 60 is further provided with two ears 63 and an assembling hole 631 in each of the ears 63. The connecting sleeve 60 is rotatably mounted on the mounting stem 40 in such a manner that the second pivot 43 is inserted in the inserting hole 61, the restricting protrusion 431 is received in the restricting cavity 62, the first inner surface 621 of the restricting cavity 62 is located toward the first abutting surface 432 of the restricting protrusion 431, and the second inner surface 622 is located toward the second abutting surface 433. By such arrangements, the connecting sleeve 60 is able to pivot around the second pivot 43 (the first direction D1) with a limited angle, as shown in FIGS. 6-8.

Figure 5:
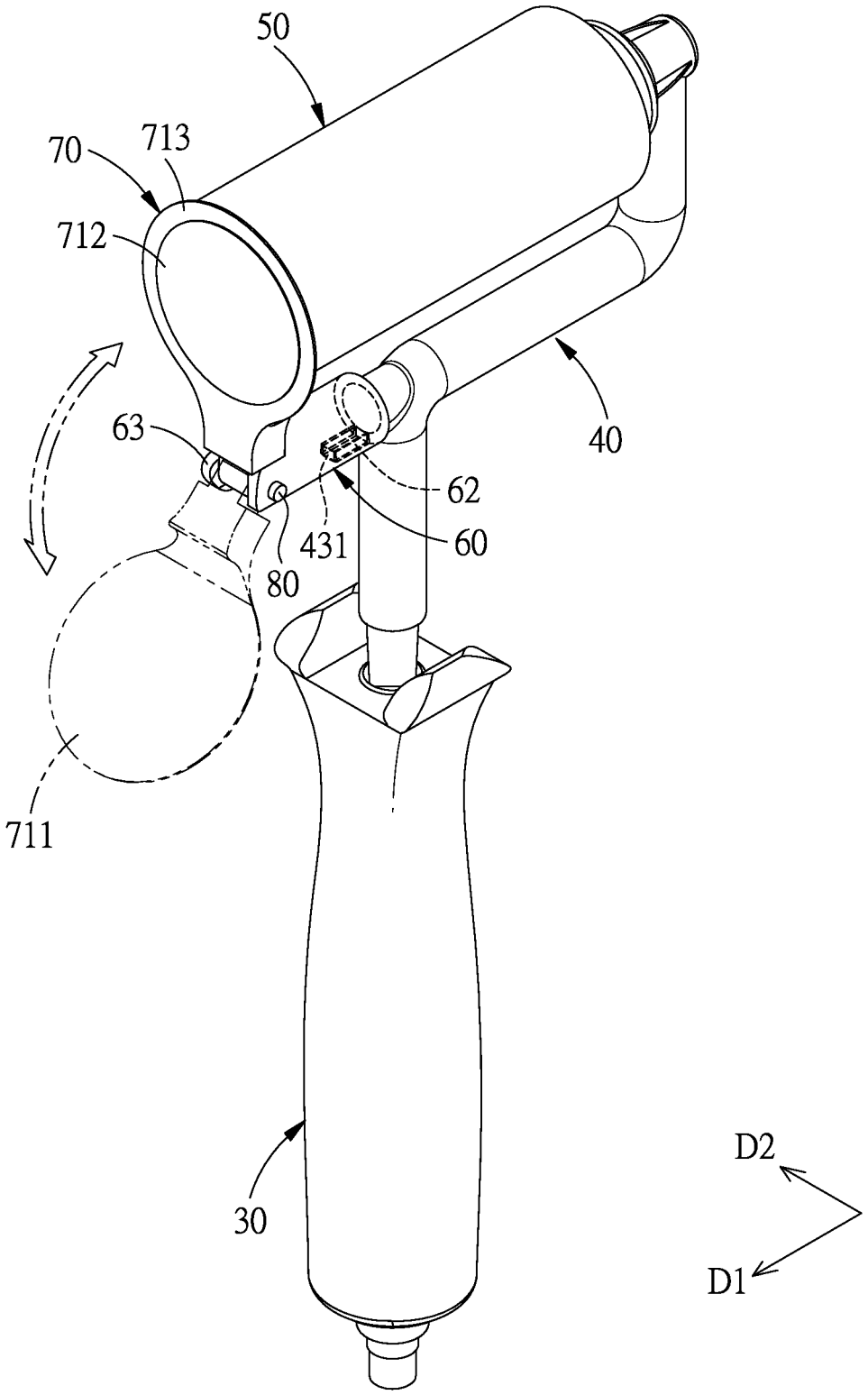
FIG. 5 shows that the end-surface blocking piece is pivoted away from the roller of the present invention.

The end-surface blocking piece 70 includes a blocking portion 71, an arm portion 72 and a pivoting portion 73 sequentially connected one another. The blocking portion 71 is a round sheet structure including an inner surface 711 and an outer surface 712, and around the periphery of the outer surface 712 is formed a blocking groove 713. The pivoting portion 73 is formed with a pivoting hole 731. The pivoting portion 73 of the end-surface blocking piece 70 is pivoted to the connecting sleeve 60 by a pin 80 which extends in the second direction D2. In this embodiment, the pivoting portion 73 is pivoted between the two ears 63 of the connecting sleeve 60 in such a manner that the pin 80 is inserted through the pivoting hole 731 of the pivoting portion 73 and the assembling holes 631 of the connecting sleeve 60, and the inner surface 711 of the blocking portion 71 of the end-surface blocking piece 70 is located toward the end surface of the roller 50. By such arrangements, the end-surface blocking piece 70 is able to pivot around the pin 80 (namely, the second direction D2) to pivot toward or away from the roller 50, as shown in FIG. 5.

When the paint roller with an end-surface blocking piece in accordance with the present invention is used to paint a corner of a first wall X1 and a second wall X2 perpendicular to the first wall X1, the roller 50 is flatly pressed against the first wall X1, and the end-surface blocking piece 70 is flatly abutted against the second wall X2. By such arrangements, the end-surface blocking piece 70 can prevent the paint of the roller 50 from dirtying the second wall X2 which shouldn't be painted when paint roller is painting the first wall X1. Even if there is too much paint on the roller 50 and the paint overflows from the inner surface 711 to the outer surface 712, the blocking groove 713 formed in the outer surface 712 of the end-surface blocking piece 70 will make the paint stay in the blocking groove 713 and prevent free flowing of the paint along the outer surface 712, so that the paint won't dirty the second wall X2 which shouldn't be painted.

Moreover, during painting, the roller 50 has to be flatly pressed against the wall so that the paint can be applied more evenly. The end-surface blocking piece 70 is larger than the end surface of the roller 50, which, in normal conditions, makes the outer peripheral edge of the end-surface blocking piece 70 protrude out of the edge of the end surface of the roller 50, therefore, the end-surface blocking piece 70 will come into contact with the wall before the roller 50 when the user intends to press the roller 50 against the wall. When the user continues to press, the end-surface blocking piece 70 will be pushed to pivot around the second pivot 43 via the connecting sleeve 60 to make the outer peripheral edge of the end-surface blocking piece 70 be flush with the edge of the end surface of the roller 50, so that the roller 50 will be pressed against the wall to perform paint operation. Since the pivoting of the end-surface blocking piece 70 is achieved by the pivot connection of the connecting sleeve 60 and the second pivot 43, and the rotation direction of the connecting sleeve 60 is restricted by the second pivot 43 and therefore is predictable, it will be easy for the user to control the painting operation.

Since the restricting protrusion 431 is received in the restricting cavity 62 to restrict the rotation of the connecting sleeve 60 with respect to the second pivot 43, and the restricting-cavity angle θ2 is larger than the restricting-protrusion angle θ1, the difference between the restricting-cavity angle θ2 and the restricting-protrusion angle θ1 will be the max rotation angle that the connecting sleeve 60 is allowed to rotate. When the first inner surface 621 of the restricting cavity 62 is stopped against the first abutting surface 432 of the restricting protrusion 431, or the second inner surface 622 is stopped against the second abutting surface 433, it means that the rotation of the connecting sleeve 60 reaches its limit and will therefore stop. The arrangement of the restricting cavity 62 and the restricting protrusion 431 restricts the rotation angle of the connecting sleeve 60, which prevents the connecting sleeve 60 from over rotation and causing instability during painting operation.

The pivot connection of the connecting sleeve 60 with the second pivot 43 allows the connecting sleeve 60 to pivot around the first direction D and allows the end-surface blocking piece 70 which is pivoted to the connecting sleeve 60 to pivot around the second direction D2, so that the end-surface blocking piece 70 is capable of rotating in two different directions, which improves flexibility when operating the paint roller of the present invention.

While we have shown and described various embodiments in accordance with the present invention, it is clear to those skilled in the art that further embodiments may be made without departing from the scope of the present invention.

What is claimed is:

1. A paint roller with an end-surface blocking structure comprising:

a handle;

a mounting stem coupled to the handle and including an extension portion on which being formed a first pivot and a second pivot which extend along a first direction, and a direction perpendicular to the first direction being defined as a second direction, the first and second pivots being cylindrical structures, on an outer surface of the second pivot being formed a restricting protrusion which includes a first abutting surface and a second abutting surface, and the first and second abutting surfaces defining a restricting-protrusion angle with respect to an axis of the second pivot;

a roller rotatably sleeved on the first pivot of the mounting stem;

a connecting sleeve including an inserting hole and a restricting cavity in communication with the inserting hole, the restricting cavity including a first inner surface and an opposite second inner surface which define a restricting-cavity angle with respect to an axis of the inserting hole, and the restricting-cavity angle being larger than the restricting-protrusion angle, the connecting sleeve being further provided with two ears, the connecting sleeve being rotatably mounted on the mounting stem in such a manner that the second pivot is inserted in the inserting hole, and the restricting protrusion is received in the restricting cavity to allow the connecting sleeve to pivot around the second pivot and the first direction within a limited angle; and an end-surface blocking piece with a blocking portion, an arm portion and a pivoting portion sequentially connected one another, the blocking portion being a round sheet structure with an inner surface and an outer surface, the pivoting portion of the end-surface blocking piece being pivoted between the two ears of the connecting sleeve in such a manner that the inner surface of the blocking portion of the end-surface blocking piece is located toward an end surface of the roller, and the end-surface blocking piece is able to pivot around the second direction to pivot toward or away from the roller.

2. The paint roller with an end-surface blocking structure as claimed in claim 1, wherein each of the ears of the connecting sleeve is formed with an assembling hole, the pivoting portion of the end-surface blocking piece is formed with a pivoting hole, the pivoting portion of the end-surface blocking piece is pivoted between the two ears of the connecting sleeve by a pin which extends in the second direction in such a manner that the pin is inserted through the pivoting hole of the pivoting portion and the assembling holes of the connecting sleeve.

3. The paint roller with an end-surface blocking structure as claimed in claim 1, wherein a blocking groove is formed around a periphery of the outer surface.

* * * * *